US006120643A

United States Patent [19]

Levit

[11] Patent Number: 6,120,643

[45] Date of Patent: Sep. 19, 2000

[54] ARAMID AND GLASS FIBER ABSORBENT PAPERS

[75] Inventor: Mikhail R. Levit, Richmond, Va.

[73] Assignee: E. I. du Pont de Nemours and Company, Wilmington, Del.

[21] Appl. No.: 09/427,785

[22] Filed: Oct. 27, 1999

[51] Int. Cl.[7] ..... D21H 13/26; D21H 13/40

[52] U.S. Cl. ..... 162/141; 162/146; 162/145; 162/156; 162/157.1; 162/157.3; 428/300.4; 428/299.4; 428/299.7

[58] Field of Search ..... 162/146, 145, 162/148, 149, 152, 156, 157.1, 157.3; 428/325, 327, 292.1, 293.4, 299.4, 299.7, 300.4

[56] References Cited

U.S. PATENT DOCUMENTS

| | | | |
|---|---|---|---|
| 3,035,965 | 5/1962 | Mathews | 162/145 |
| 3,622,445 | 11/1971 | Heidweiller | 162/145 |
| 3,920,428 | 11/1975 | Kinsley, Jr. | 55/528 |
| 4,162,934 | 7/1979 | Norback | 162/155 |
| 4,678,822 | 7/1987 | Lewellin | 524/12 |
| 5,126,012 | 6/1992 | Hendren et al. | 162/146 |
| 5,154,798 | 10/1992 | Melacini et al. | 162/145 |
| 5,188,888 | 2/1993 | McReynolds | 428/220 |
| 5,409,573 | 4/1995 | Weeks | 162/145 |
| 5,431,782 | 7/1995 | Cassat | 162/145 |
| 5,580,369 | 12/1996 | Belding et al. | 96/125 |
| 5,683,532 | 11/1997 | Kuma | 156/184 |
| 5,906,712 | 5/1999 | Asami et al. | 162/156 |
| 5,910,231 | 6/1999 | Kirayoglu et al. | 162/145 |

*Primary Examiner*—Stanley S. Silverman
*Assistant Examiner*—Jose A. Fortuna

[57] ABSTRACT

The present invention relates to highly absorbent paper made using a combination of aramid fibers and glass fibers with fibrids or resin as a binder material.

8 Claims, No Drawings

ARAMID AND GLASS FIBER ABSORBENT PAPERS

BACKGROUND OF THE INVENTION

1. Field of the Invention

This invention relates to paper that exhibits high water absorbency and high strength. The paper is made using a combination of aramid and glass components and the absorbency is measured by water pickup and water migration.

2. Description of Related Art

U.S. Pat. No. 3,920,428, issued Nov. 18, 1975 on the application of H. B. Kinsley discloses an aramid filter paper made from glass fibers and aromatic polyamide fibers fused together by heat. One source of aromatic polyamide fibers is stated, therein, to be disintegrated paper made from aromatic polyamide fibers and fibrids. The fibrids used in that patent are dried before they are used in manufacture of the paper.

U.S. Pat. No. 5,126,012, issued Jun. 30, 1992 on the application of G. L. Hendren et al. Discloses manufacture of a paper using fibers of carbon or glass or aramid and bound by aramid fibrids. The papers therein do not have a combination of fibers and are not disclosed to be water absorbent.

BRIEF SUMMARY OF THE INVENTION

This invention relates to an absorbent paper comprising 10 to 45 weight percent aramid floc, greater than 30 weight percent glass fiber, and a total of 65 to 85 weight percent combined aramid floc and glass fiber. The paper evidences absorbency exhibited by at least 200 weight percent water pickup and at least 4 centimeters water migration, as will be defined hereinbelow.

The paper of this invention includes a binder of fibrids and may include a resin as an additional binder for the aramid floc and the glass fibers. The fibrids can be aramid fibrids and the binder can be present in an amount of 15 to 35 weight percent based on the total weight of the paper.

DETAILED DESCRIPTION OF THE INVENTION

Highly absorbent and durable papers find use, among others, as media for water absorption in humidification and dehumidification processes. Such papers must exhibit a capability for water migration through the paper and a high internal absorption capacity or water pickup. This invention relates to an absorbent paper exhibiting remarkably high water pickup and water migration by virtue of a specially developed combination of paper fiber components and high strength as measured by tensile and tear strength. The absorbent paper of this invention includes a combination of aramid floc and glass fiber as the primary fiber components.

By "aramid floc" is meant fibers having a length of 3 to 25 millimeters, preferably 4 to 7 millimeters, a diameter of 5 to 20 micrometers, preferably 7 to 14 micrometers, and made from aramid material. If the floc length is less than 3 millimeters, the paper will lack necessary strength; and if it is more than 25 millimeters, the floc becomes entangled with itself and it becomes very difficult to make paper of a uniform thickness. Floc is generally made by cutting continuous spun filaments into floc-length pieces. "Aramid" materials are polyamides wherein at least 85% of the amide (—CO—NH—) linkages are attached directly to two aromatic rings. Additives can be used with the aramid and it has been found that up to as much as 10 percent, by weight, of other polymeric material can be blended with the aramid and that copolymers can be used having as much as 10 percent of other diamine substituted for the diamine of the aramid or as much as 10 percent of other diacid chloride substituted for the diacid chloride or the aramid.

Meta-aramids are the primary polymers in fibers of this invention and poly(m-phenylene isophthalamide)(MPD-I) is the preferred meta-aramid. By MPD-I is meant the homopolymer resulting from mole- for-mole polymerization of m-phenylene diamine and isophthaloyl chloride and, also, copolymers resulting from incorporation of small amounts of other diamines with the m-phenylene diamine and of small amounts of other diacid chlorides with the isophthaloyl chloride. PPD-T fibers, alone, and blended with meta-aramid fibers, can also be used as aramid floc in this invention.

By "glass fiber" is meant fibers made using glass of various types. The glass fibers used in papers of the present invention include glass types known by the designations: A, C, D, E, Zero Boron E, ECR, AR, R, S, S-2, N, and the like, and generally, any glass that can be made into fibers either by drawing processes used for making reinforcement fibers or spinning processes used for making thermal insulation fibers.

Glass fibers used in the papers of this invention generally have a length of 2 to 30 millimeters and a diameter of 0.3 to 12 micrometers. Glass fibers with a length less than 2 millimeters yield paper having inadequate void volume for high water pickup and glass fibers with a length of more than 30 millimeters tangle and produce nonuniform papers. Glass fibers are preferred which have a diameter of 0.6 to 8 micrometers.

Aramid floc and glass fibers in the paper of this invention can be uncolored or colored by dyes or pigments and the glass fibers can be straight or curly or even spiral or other configuration. The floc and fibers can be treated or not by materials which alter their surface characteristics so long as such treatment does not adversely affect the ability of binders to contact and hold to the fiber surfaces.

It has been determined that a binder component is necessary to obtain adequate strength for the papers of this invention. The binder component includes 15 to 35 weight percent fibrids, based on the total weight of the paper. Fibrids can be used as binder without excessively diminishing the absorbency of the resulting paper. Although use of a resin binder does significantly decrease absorbency of the paper, up to as much as 10 weight percent of a resin binder, based on the total weight of the paper excluding the resin binder, can be used in addition to the fibrids. For purposes of calculation in this invention, the concentration of resin binder in a paper is reported as weight percent based on total weight of the paper excluding the resin binder; and the concentration of fibrid binder is reported as weight percent based on total weight of the paper.

Fibrids are made by streaming a polymer solution into a coagulating bath of liquid that is immiscible with the solvent of the solution. The stream of polymer solution is subjected to strenuous shearing forces and turbulence as the polymer is coagulated and the result is a very finely-divided polymer product of small, filmy, essentially two- dimensional, particles known as fibrids and having a length and width on the order of 100 to 1000 microns and a thickness more than one hundred times less, on the order of 0.1 to 1 micron.

For so long as these fibrids are kept wet with the coagulating liquid, they maintain their two- dimensional, filmy, configuration; and can be called never-dried fibrids. As never-dried fibrids are subjected to drying forces, the polymer material tends to pleat or collapse and, generally, shrink and be reduced in surface area. When the fibrids are dried to a moisture level of less than about twenty weight percent based on the weight of the polymer, the molecular configuration is irreversibly collapsed and the particles no longer have the filmy nature which is an inherent quality of never-dried fibrids.

In the paper of the present invention, fibrids are used as the binder material to bind adjacent fibers together. The fibrids that are useful for this binding are the two-dimensional, filmy, fibrids identified as never-dried fibrids. Never-dried fibrids, on contact with the fibers, enwrap and entangle the fibers by virtue of the filmy and pliant nature of the never-dried configuration. When the fibrids and the entangled fibers are then dried, the never-dried fibrids shrink and more closely enwrap the fibers to make a tight, solid, structure of bonded fibers. The dried fibrids which are present in this structure of tightly bonded glass fibers—the fibrids of this invention—are called once-dried fibrids. Never-dried fibrids can be used as effective binder material only once—the first time that they are dried. Therefore, those never-dried fibrids in the bound product are, "once-dried fibrids".

When never-dried fibrids have been dried and attempts are then made to redisperse those once-dried fibrids, the redispersed, once-dried, fibrids are particulate or granular rather than filmy and do not exhibit the pliant, enwrapping, character of never-dried fibrids. As a consequence, previously dried fibrids cannot serve as an effective binder material. only never-dried fibrids operate as effective binder materials and, in the making of a bound product, the never-dried fibrids become once-dried fibrids. The paper of this invention which is made with a fibrid binder material is made with never-dried fibrids.

The preferred material for the fibrids of this invention are generally aramids, specifically, meta-aramids, and, more specifically, poly(m-phenylene isophthalamide). Other fibrid materials eligible for use in this invention, include polyacrylonitrile, polycaproamide, poly(ethylene terephthalate), and the like. Aramid fibrids provide increased thermal stability.

The never-dried fibrids are used in concentrations ranging from 15 to 35 weight percent based on the total weight of the paper. Too low a concentration of fibrids causes a low strength and lack of structural integrity in the composition and too high a concentration causes reduced water pickup in the resulting paper. The preferred fibrid concentration range is from 20 to 30 weight percent.

Resin used as binder can be in the form of water soluble or dispersible polymer added directly to the paper making dispersion or in the form of thermoplastic binder fibers of the resin material intermingled with the aramid and glass fibers to be activated as a binder by heat applied after the paper is formed. The preferred materials for the water soluble or dispersible binder polymer are water soluble or water dispersible thermosetting resins such as polyamide resins, epoxy resins, phenolic resins, polyureas, polyurethanes, melamine formaldehyde resins, polyesters and alkyd resins, generally, and specifically, water soluble polyamide resins, that are in common use in the papermaking industry (such as the cationic wet-strength resin sold by Hercules, Inc. under the tradename KYMENE® 557LX). Water solutions and dispersions of non-cured polymers can be used as well (poly(vinyl alcohol), poly(vinyl acetate) and the like). Thermoplastic binder fibers can be polymers such as poly(vinyl alcohol), polypropylene, polyester, and the like, and should have a length and diameter similar to those of the aramid and glass fibers.

The paper of this invention can be made on equipment of any scale from laboratory screens to commercial-sized papermaking machinery such as Fourdrinier, inclined wire, and cylinder wire machines, and combinations of them. The general process involves making a dispersion of aramid fibers, glass fibers, and binder material in an aqueous liquid, draining the liquid from the dispersion to yield a wet composition, and drying the wet paper composition.

The dispersion can be made by dispersing the fibers and then adding the binder material or dispersing the binder material and then adding the fibers. The dispersion can, also, be made by combining a dispersion of fibers with a dispersion of the binder material. The concentration of fibers in the dispersion can range from 0.01 to 1 weight percent based on the total weight of the dispersion. The concentration of binder material in the dispersion can range from 10 to 50 weight percent based on the weight of the fibers; and, if the binder material is fibrids, the concentration can range from 15 to 35 weight percent based on the total weight of the paper.

The aqueous liquid of the dispersion is generally water, but may include various other materials such as pH adjusting materials, surfactants, defoamers, and the like. The aqueous liquid is usually drained from the dispersion by conducting the dispersion onto a screen or other perforated support retaining the dispersed solids and passing the liquid to yield a wet paper composition. The wet composition, once formed on the support, is usually further dewatered by vacuum or other pressure forces and further dried by evaporating the remaining liquid.

TEST METHODS

Tear Strenqth was determined for papers of this invention on an Elmendorf-type testing machine in accordance with procedures and calculations set out in ASTM D 689-96a.

Tensile Strength was determined for papers of this invention on an Instron-type testing machine using test specimens 2.54 cm wide and a gage length of 18 cm in accordance with ASTM D 828.

Water Pickup (Internal Absorption Capacity) is determined by immersing a weighed sheet of test paper, 10.2 cm×10.2 cm (4 inches×4 inches), in water until fully saturated, removing the paper from the water, lightly contacting both surfaces of the paper with a blotter to remove surface moisture, and weighing the saturated paper sheet. Internal Absorption Capacity (IAC), as a percent, is calculated by the following equation:

$$IAC\% = \frac{(\text{Weight, saturated}) - (\text{Weight, dry})}{(\text{Weight, dry})}$$

Water Migration is determined by immersing one end of a strip of test paper, 2.5 cm (1 inch) wide, in water and measuring the height of the absorbed water front after one minute.

Thickness and Basis Weight were determined by measuring the thickness and the weight of an area of a sample of the test paper in accordance with ASTM D 645 and D 646, respectively.

The absorbent paper of this invention exhibits at least 200 weight percent water pickup and at least 4 centimeters water migration, as determined by the aforedescribed Test Methods. It is the combination of aramid floc and glass fiber which yields these absorbency results;—with neither aramid floc alone nor glass fiber alone exhibiting the required absorbency. The combination is required and, within other limits identified in the claims, the paper must include from 65 to 85 weight percent of the combination, based on total weight of the paper.

EXAMPLES

Example 1

An aqueous dispersion was made of never-dried meta-aramid fibrids at a 0.5% consistency (0.5 weight percent solid materials in water). Under continuing agitation, glass fibers were added; and, after fifteen minutes of continued agitation, aramid floc was added. After five additional minutes of agitation, water was added to yield a final consistency of 0.2%. The solid materials were:

Meta-aramid fibrids—30%

Meta-aramid floc—30%

Glass fiber—40%.

The meta-aramid fibrids were made from poly (metaphenylene isophthalamide) as described in U.S. Pat No. 3,756,908. The meta-aramid floc was poly (metaphenylene isophthalamide) floc of linear density 0.22 tex (2.0 denier) and length of 0.64 cm (sold by E.I. du Pont de Nemours and Company under the trade name NOMEX®). The glass fiber was type 253, code 206 borosilicate glass microfiber sold by Johns Manville Co.

The resulting dispersion was pumped to a supply chest, and fed from there to a Fourdrinier to make paper with a basis weight of 33.9 g/m$^2$. Other properties of the paper are described in the Table below.

Example 2

A slurry was prepared as in Example 1 with the exception that a wet-strength resin identified as KYMENE 557LX and sold by Hercules, was added in the quantity of 5 weight percent of the solid components excluding the weight of the resin.

A paper with a basis weight of 32.9 g/m$^2$ was formed on a Fourdrinier. Other properties of the paper are described in the Table below.

Example 3

A slurry was prepared as in Example 1 with the exception that the amounts of solid components were as follows:

Meta-aramid fibrids—30%

Meta-aramid floc—15%

Glass fiber—55%.

A paper with a basis weight of 34.2 g/m$^2$ was formed. Other properties of the paper are described in the Table below.

Example 4

A slurry was prepared as in Example 1, but the paper was formed on an inclined wire machine. The final paper had a basis weight of 35.6 g/m$^2$. Other properties of the paper are described in the Table below.

Example 5

0.96 g of glass fiber was placed in a Waring Blendor with 800 ml of water and was agitated for 3 min. After that, 41.4 g of an aqueous, never-dried, fibrid slurry (0.58% consistency and freeness 330 ml of Shopper-Riegler) and the water dispersion of glass fiber from the Waring Blendor were placed together in a laboratory mixer (British pulp evaluation apparatus) with about 1600 g of water. After agitating for 2 min, 0.48 g of para-aramid floc and 0.48 g of meta-aramid floc were added, and the dispersion was agitated for 1 minute more.

The solid materials in the slurry were:

Meta-aramid fibrids—20%

Meta-aramid floc—20%

Para-aramid floc—20%

Glass fiber—40%

The meta-aramid fibrids and the meta-aramid floc were the same as described in Example 1. The para-aramid floc was floc made from poly(para-phenylene terephthalamide) having a linear density of 0.24 tex (2.2 denier) and a length of 0.64 cm (sold by E.I. du Pont de Nemours and Company under the trade mark KEVLAR®49). The glass fiber was chopped strand type M189 (1.77 cm long) produced by Johns Manville Co.

The dispersion was poured, with 8 liters of water, into an approximately 21×21 cm handsheet mold and a wet-laid sheet was formed. The sheet was placed between two pieces of blotting paper, hand couched with a rolling pin, and dried in a handsheet dryer at 190° C.

The final paper had a basis weight of 56.6 g/m$^2$. Other properties of the paper are described in the Table below.

Example 6

51.7 g of a never-dried meta-aramid fibrid slurry (0.58% consistency and freeness 330 ml of Shopper-Riegler) and 0.8 g of glass fiber were placed in a laboratory mixer with about 2400 g of water. After agitating for 2 min, 0.9 g of meta-aramid floc was added, and the slurry was agitated for an additional 0.5 min.

The solid materials in the slurry were:

Meta-aramid fibrids—15%

Meta-aramid floc—45%

Glass fiber—40%

The meta-aramid fibrids, the meta-aramid floc, and the glass fiber were the same as described in Example 1. The dispersion was poured, with 8 liters of water, into an approximately 21×21 cm handsheet mold and a wet-laid sheet was formed. The sheet was placed between two pieces of blotting paper, hand couched with a rolling pin, and dried in a handsheet dryer at 190° C.

The final paper had a basis weight of 53.2 g/m$^2$. Other properties of the paper are described in the Table below.

Example 7

The slurry was prepared as in Example 6 with the exception that a wet-strength resin identified as KYMENE 557LX and sold by Hercules, was added in the quantity of 2 weight percent of the solid components excluding the weight of the resin.

A paper was formed as described in Example 6 with a basis weight of 53.0 g/m$^2$. Other properties of the paper are described in the Table below.

Example 8

A paper was prepared as in Example 7 with the exception that the wet-strength resin was added in the quantity of 5 weight percent of the solid components excluding the weight of the resin.

A paper was formed as described in Example 6 with a basis weight of 52.9 g/m$^2$. Other properties of the paper are described in the Table below.

Example 9

A paper was prepared as in Example 7 with the exception that the wet-strength resin was added in the quantity of 10 weight percent of the solid components excluding the weight of the resin.

A paper was formed as described in Example 6 with a basis weight of 52.9 g/m$^2$. Other properties of the paper are described in the Table below.

Example 10

A slurry was prepared as in Example 6 with the exception that the amounts of solid components were as follows:

Meta-aramid fibrids—20%

Meta-aramid floc—10%

Glass fiber—70%

The glass fiber was type 253 code 210X borosilicate glass microfibers sold by Johns Manville Co. The meta-aramid fibrids and the meta-aramid floc were the same as in Example 1.

The final paper had a basis weight of 47.5 g/m$^2$. Other properties of the paper are described in the Table below.

Example 11

62.0 g of never-dried meta-aramid fibrid slurry (0.58% consistency and freeness 330 ml of Shopper-Riegler) and 1.2 g of glass fiber were placed in a laboratory mixer with about 2400 g of water. After agitating for 2 min, 0.48 g of para-aramid floc was added, and the slurry was agitated for 1 additional minute.

The solid materials in the slurry were:

Meta-aramid fibrids—30%

Para-aramid floc—20%

Glass fiber—50%

The meta-aramid fibrids were the same as described in Example 1 and the para-aramid floc was the same as described in Example 5. The glass fiber was the same as described in Example 5.

The dispersion was poured, with 8 liters of water, into an approximately 21×21 cm handsheet mold and a wet-laid sheet was formed. The sheet was placed between two pieces of blotting paper, hand couched with a rolling pin, and dried in a handsheet dryer at 190° C.

The final paper had a basis weight of 56.6 g/m$^2$. Other properties of the paper are described in the Table below.

Example 12

A paper was prepared as in Example 5, but with the following solid components:

Meta-aramid fibrids—35%

Meta-aramid floc—10%

Glass fiber—55%.

The final paper had a basis weight of 47.0 g/m$^2$. Other properties of the paper are described in the Table below.

Example 13

A paper was prepared as in Example 5, but with the following solid components:

Meta-aramid fibrids—35%

Meta-aramid floc—35%

Glass fiber—30%.

The final paper had a basis weight of 45.1 g/m$^2$. Other properties of the paper are described in the Table below.

Example 14

(Control)

A paper was prepared as in Example 5, but with the following solid components:

Meta-aramid fibrids—40%

Meta-aramid floc—10%

Glass fiber—50%.

The final paper had a basis weight of 47.1 g/m$^2$. Other properties of the paper are described in the Table below.

Example 15

(Control)

A paper was prepared as in Example 5, but with the following solid components:

Meta-aramid fibrids—35%

Glass fiber—65%.

The final paper had a basis weight of 45.8 g/m$^2$. Other properties of the paper are described in the Table below.

Example 16

(Control)

A paper was prepared as in Example 5, but with the following solid components:

Meta-aramid fibrids—35%

Meta-aramid floc—5%

Glass fiber—60%.

The final paper had a basis weight of 49.2 g/m$^2$. Other properties of the paper are described in the Table below.

Example 17

(Control)

1.6 g of an aramid paper wdith a density of 0.31 g/cm$^3$, was mixed with 800 ml of water and was disintegrated in a Waring Blendor for 1 min. After that, a dispersion of 0.4 g of glass fiber in 800 ml of water was prepared separately in the same blender as described in Example 5. The aramid paper was 51 weight percent once-dried meta-aramid fibrids and 49 weight percent meta-aramid floc. The glass fiber was the same as described in Example 5.

Both dispersions were mixed together for 1 min in a laboratory mixer and a paper was prepared as described in Example 5.

The final paper had a basis weight of 45.8 g/m$^2$. Other properties of the paper are described in the Table below.

Example 18

(Control)

An aqueous dispersion was made of never-dried meta-aramid fibrids at a consistency of 0.5% and a Shopper-Riegler freeness of 350 ml and, under continuing agitation, meta-aramid floc was added. After five additional minutes of agitation, wet-strength resin and water was added to a final consistency of 0.2%. The solid materials were:

Meta-aramid fibrids—25%

Meta-aramid floc—75%

Resin—5% based on weight of solid components excluding the weight of the resin.

The meta-aramid fibrids and the meta-aramid floc were the same as described in Example 1 and the resin was the same as described in Example 2.

The resulting dispersion was pumped to a supply chest and fed from there to an inclined wire papermaking machine, to make paper with a basis weight of 35.9 g/m$^2$. Other properties of the paper are described in the Table below.

Example 19

(Control)

A slurry was prepared as in Example 2, with the amounts of solid components as follows:

Meta-aramid fibrids—30%

Meta-aramid floc—50%

Glass fiber—20%

Resin—5% based on weight of solid components excluding the weight of the resin.

A paper with a basis weight of 37.0 g/m$^2$ was formed on a Fourdrinier machine. Other properties of the paper are described in the Table below.

Example 20

(Control)

34.5 g of never-dried meta-aramid fibrid slurry (0.58% consistency and freeness 330 ml of Shopper-Riegler) and 1.7 g of glass fiber were placed in a laboratory mixer with about 2400 g of water. After agitating for 2 min, 0.1 g of meta-aramid floc was added, and the slurry was agitated for an additional 0.5 min.

The solid materials in the slurry were:

Meta-aramid fibrids—10%

Meta-aramid floc—5%

Glass fiber—85%

The meta-aramid fibrids, the meta-aramid floc, and the glass fibers were the same as described in Example 1.

The final paper had a basis weight of 41.7 g/m$^2$. Other properties of the paper are described in the Table below.

Example 21

(Control)

A paper was prepared as in Example 20 except that a resin was added to the slurry in the quantity of 5 weight percent of the solid components. The resin was the same as described in Example 2.

The final paper had a basis weight of 48.8 g/m$^2$. Other properties of the paper are described in the Table below.

TABLE

| | Paper composition (%) | | | Combined | Resin (% | | | Tensile | | | Water | |
|---|---|---|---|---|---|---|---|---|---|---|---|---|
| Example | Fibrids | Floc | Glass Fiber | Floc + Glass (%) | Of paper ex resin) | Basis Wt. (g/m$^2$) | Thickness (mm) | index (N*m/g) | Elongation (%) | Tear index (mN/(g/m$^2$)) | pick-up (%) | Water Rise (cm) |
| 1 | 30 | 30 | 40 | 70 | — | 33.9 | 0.14 | 8.8 | 1.2 | 6.5 | 220 | 5.5 |
| 2 | 30 | 30 | 40 | 70 | 5 | 32.9 | 0.13 | 11.9 | 1.3 | 9.7 | 250 | 5.4 |
| 3 | 30 | 15 | 55 | 70 | — | 34.2 | 0.14 | 10.3 | 1.9 | 6.4 | 250 | 4.8 |
| 4 | 30 | 30 | 40 | 70 | — | 35.6 | 0.15 | 10.6 | 1.5 | 10.8 | 230 | 4.6 |
| 5 | 20 | 40 | 40 | 80 | — | 56.6 | 0.22 | 13.9 | 1.3 | 8.3 | 230 | 5.2 |
| 6 | 15 | 45 | 40 | 85 | — | 53.2 | 0.20 | 7.5 | 0.9 | 7.6 | 230 | 5.0 |
| 7 | 15 | 45 | 40 | 85 | 2 | 53.0 | 0.19 | 7.7 | 0.9 | 7.8 | 230 | 4.8 |
| 8 | 15 | 45 | 40 | 85 | 5 | 52.9 | 0.21 | 10.6 | 1.2 | 10.4 | 230 | 4.5 |
| 9 | 15 | 45 | 40 | 85 | 10 | 52.9 | 0.22 | 15.0 | 1.4 | 12.1 | 220 | 4.2 |
| 10 | 20 | 10 | 70 | 80 | — | 47.5 | 0.19 | 8.3 | 0.9 | 5.5 | 290 | 4.7 |
| 11 | 30 | 20 | 50 | 70 | — | 56.6 | 0.23 | 14.2 | 1.3 | 6.3 | 230 | 5.1 |
| 12 | 35 | 10 | 55 | 65 | — | 47.0 | 0.15 | 14.0 | 2.0 | 8.9 | 220 | 4.2 |
| 13 | 35 | 35 | 30 | 65 | — | 45.1 | 0.14 | 12.1 | 1.5 | 20.9 | 220 | 4.6 |
| 14 (control) | 40 | 10 | 50 | 60 | — | 47.1 | 0.15 | 15.6 | 2.0 | 10.0 | 200 | 3.0 |
| 15 (control) | 35 | 0 | 65 | 65 | — | 45.8 | 0.13 | 11.0 | 2.0 | 4.6 | 210 | 2.8 |
| 16 (control) | 35 | 5 | 60 | 65 | — | 49.2 | 0.15 | 12.9 | 2.2 | 7.3 | 220 | 3.1 |
| 17 (control) | (70% aramid paper) | | 30 | 30 | — | 45.8 | 0.14 | 3.5 | 0.7 | 10.1 | 230 | 3.2 |
| 18 (control) | 25 | 75 | — | 75 | 5 | 35.9 | 0.16 | 20.0 | 2.4 | 31.0 | 200 | 3.1 |
| 19 (control) | 30 | 50 | 20 | 70 | 5 | 37.0 | 0.14 | 20.4 | 1.8 | 10.6 | 170 | 4.6 |
| 20 (control) | 10 | 5 | 85 | 90 | | 41.7 | 0.15 | 0.8 | 0.8 | 3.1 | 410 | 3.0 |
| 21 (control) | 10 | 5 | 85 | 90 | 5 | 48.8 | 0.19 | 3.0 | 1.3 | 4.2 | 340 | 3.0 |

What is claimed is:

1. Absorbent paper exhibiting at least 200 weight percent water pickup and at least 4 centimeters water migration and comprising 10 to 45 weight percent aramid floc with a length of 3 to 25 millimeters and greater than 30 weight percent glass fiber with a length of 2 to 30 millimeters, wherein the total amount of combined aramid floc and glass fiber is 65 to 85 weight percent based on total weight of the paper.

2. The absorbent paper of claim 1 wherein there is, additionally, 15 to 35 weight percent, based on total weight of the paper, of once-dried fibrids as a binder for the aramid floc and the glass fibers.

3. The absorbent paper of claim 2 wherein the fibrids are aramid fibrids.

4. The absorbent paper of claim 3 wherein the aramid of the fibrids and the floc is a meta-aramid.

5. The absorbent paper of claim 2 wherein the paper also comprises up to 10 weight percent binder resin, based on total weight of the paper excluding the resin.

6. The absorbent paper of claim 1 wherein the aramid of the aramid floc is para-aramid.

7. The absorbent paper of claim 1 wherein the paper also comprises up to 10 weight percent binder resin based on total weight of the paper excluding the resin.

8. The absorbent paper of claim 7 wherein the binder resin includes thermoplastic fibers.

* * * * *